US008360803B2

(12) United States Patent
Sakai

(10) Patent No.: US 8,360,803 B2
(45) Date of Patent: Jan. 29, 2013

(54) ELECTRICAL TERMINAL CONNECTION WITH MOLDED SEAL

(75) Inventor: Atsushi Sakai, Miyoshi (JP)

(73) Assignee: Delphi Technologies, Inc., Troy, MI (US)

( * ) Notice: Subject to any disclaimer, the term of this patent is extended or adjusted under 35 U.S.C. 154(b) by 195 days.

(21) Appl. No.: 12/883,319

(22) Filed: Sep. 16, 2010

(65) Prior Publication Data

US 2011/0070770 A1 Mar. 24, 2011

Related U.S. Application Data

(60) Provisional application No. 61/243,690, filed on Sep. 18, 2009.

(51) Int. Cl.
*H01R 13/52* (2006.01)

(52) U.S. Cl. ..... 439/523

(58) Field of Classification Search ..... None
See application file for complete search history.

(56) References Cited

U.S. PATENT DOCUMENTS

| | | | | |
|---|---|---|---|---|
| 4,043,893 | A | 8/1977 | Gelfand | |
| 5,035,658 | A | 7/1991 | Berg | |
| 6,866,537 | B2 | 3/2005 | Yuasa et al. | |
| 7,544,892 | B2 * | 6/2009 | Susai et al. | 174/84 R |
| 2001/0003687 | A1 | 6/2001 | Kondo | |
| 2005/0095892 | A1 | 5/2005 | Fukuyama | |
| 2006/0121773 | A1 | 6/2006 | Ichikawa et al. | |
| 2007/0264873 | A1 | 11/2007 | Kakuta | |
| 2010/0084159 | A1 | 4/2010 | Drew et al. | |

FOREIGN PATENT DOCUMENTS

| | | |
|---|---|---|
| EP | 1796216 | 4/2008 |

OTHER PUBLICATIONS

International Search Report.

* cited by examiner

*Primary Examiner* — Vanessa Girardi
(74) *Attorney, Agent, or Firm* — J. Gordon Lewis

(57) ABSTRACT

A corrosion resistant electrical connection structure has an electrically conductive cable with an electrically conductive core and an insulative outer cover. An electrically conductive terminal is electrically connected to a lead of the core that extends beyond the insulative outer cover. A molded hot melt seal seals the lead of the core and the terminal interface section from ambient electrolytes. In an exemplary embodiment, the core is made from aluminum or an aluminum alloy and the terminal is made from a copper alloy.

14 Claims, 5 Drawing Sheets

ELECTRICAL TERMINAL CONNECTION WITH MOLDED SEAL

PRIORITY

The application claims the benefit of U.S. provisional patent application Ser. No. 61/243,690, filed Sep. 18, 2009, which is hereby incorporated by reference.

TECHNICAL FIELD

The field of this invention relates to an electrical connection between a cable and a terminal with a molded seal to reduce corrosion.

BACKGROUND OF THE DISCLOSURE

Insulated copper based cable is commonly used for automotive wiring. Copper has high conductivity, good corrosion resistance and adequate mechanical strength. However, copper and copper based alloys are relatively expensive and are also heavy.

Interest in weight savings and cost savings in automotive electrical wiring applications have made aluminum based cables an attractive alternative to copper based cables. However, some wiring and electrical connectors may remain copper based. Thus, there may be a transition somewhere in the electrical circuit between an aluminum based portion of the circuit and a copper based portion of the circuit. Often this transition may occur at the terminal because the terminal may remain copper based for reasons of size and complexity of shape that can be more easily achieved with copper based materials over aluminum based materials. The crimp interface connection of aluminum based cable to a copper based terminal can produce a galvanic corrosion of the aluminum at the interface, if an electrolyte, for example salt water, is present. The galvanic reaction corrodes the aluminum because the aluminum or aluminum alloy has a different galvanic potential than the copper or copper alloys of the terminals. "Copper based" as used in this document means pure copper, or a copper alloy where copper is the main metal in the alloy. Similarly, "aluminum based" as used in this document means pure aluminum or an aluminum alloy where aluminum is a main metal in the alloy.

It has long been known to apply grease to cover the interface between a cable and a terminal. However, grease has been shown to be an ineffective preventative in the long term under harsh automotive environments where salt sprays and water pressures can easily wear away at the grease and expose the crimp interface. In the case of an aluminum and copper interface, even a small amount of exposed aluminum cable can contribute to significant galvanic corrosion.

What is needed is a connection between aluminum based cable and copper based terminals with improved corrosion resistance through an improved seal to seal the aluminum cable from an electrolyte. What is also needed is a durable and complete seal about a terminal connection for reducing galvanic induced corrosion.

SUMMARY OF THE DISCLOSURE

In accordance with one aspect of the invention, an electrical connection structure includes a conductive cable core, a terminal connected to the cable core, and a molded hot melt seal bonded to the cable core and the terminal. The hot melt seal intimately surrounds and substantially fills any space around the entire interface of the cable core with the terminal and seals the interface from ambient electrolytes.

In an exemplary embodiment, the conductive cable core is made from aluminum or an aluminum alloy and the terminal is made from a copper alloy.

In accordance with another aspect of the invention, the electrical connection structure further includes an insulative outer cover surrounding the cable core, an exposed lead of the core disposed at one end of the core, the terminal comprising a pair of insulation crimp wings and a pair of core crimp wings, the insulation crimp wings crimped onto the insulative outer cover and the core crimp wings crimped onto and making electrical contact with the exposed lead, and the molded hot melt seal secured about the insulation crimp wings and the core crimp wings and intimately surrounding and substantially filling any space around the exposed lead.

In accordance with yet another embodiment of the invention, the electrical connection structure further includes a connector housing that defines a cavity having an opening, the cavity receiving the exposed lead and the core crimp wings, the outer cover extending from an axial end at the exposed lead through the opening, the molded hot melt seal entirely surrounding a length of the outer cover that extends from the axial end to a location on the cover spaced a distance apart from the housing. The hot melt seal suppresses flexing of the length of the outer cover. Such an embodiment is advantageous for providing strain relief and enhancing sealing performance in applications where the cable is subject to flexing forces outside the housing.

In accordance with another aspect of the invention, a corrosion resistant electrical connection structure includes an electrically conductive cable having a core made from a first electrically conductive material and an insulative outer cover surrounding substantially an entire length of the core except for an uncovered portion that is free of the insulative outer cover, a terminal electrically connected to the uncovered portion, the terminal being made of a second electrically conductive material that is less electro-negative than the first electrically conductive material when exposed to an electrolytic environment, and a molded hot melt seal bonded to the cable and the terminal, the hot melt seal surrounding and substantially filling any space around both the uncovered portion of the core and the interface of the uncovered portion with the terminal, whereby the interface and the uncovered portion are effectively isolated and protected from exposure to ambient electrolytes. In a preferred embodiment, the first electrically conductive material is aluminum or an aluminum alloy and the second electrically conductive material is copper or a copper alloy, which is less electro-negative than aluminum or an aluminum alloy when exposed to an electrolytic environment.

In one embodiment, the core is made from a plurality of strands that when crimped has voids which are filled with the molded hot melt seal.

Preferably, the hot melt material is from the group consisting of a polyolefin, a polyurethane, a polyamide or a polyester material. In one embodiment, the hot melt material is a polyolefin material. In another embodiment, the hot melt material is a polyurethane material. In another embodiment, the hot melt material is a polyamide material. In another embodiment, the hot melt material is a polyurethane material.

In accordance with yet another aspect of the invention, a method of forming a seal about an aluminum based core of a cable with an insulative outer cover and a copper based terminal includes the steps of providing a lead of the core extending beyond an axial edge of the insulative outer cover; crimping the copper based terminal onto the lead to provide electrical contact between the lead and the terminal; and placing an interfacing section of the terminal and the lead into a mold cavity and injecting a hot melt material to provide a molded seal over the terminal interface with the lead. The method preferably includes holding pressure in the mold while it cools down. The terminal is then removed from the mold after it is cooled.

In accordance with another aspect of the invention, the method preferably includes the hot melt material being selected from the group consisting of a polyolefin, a polyurethane, a polyamide and a polyester material. In one embodiment of the method, the hot melt material is a polyolefin material. In another embodiment, the hot melt material is a polyurethane material. In another embodiment, the hot melt material is a polyamide material. In another embodiment, the hot melt material is a polyester material.

Further features, uses and advantages of the invention will appear more clearly on a reading of the following detailed description of the preferred embodiment of the invention, which is given by way of non-limiting example only and with reference to the accompanying drawings.

BRIEF DESCRIPTION OF THE DRAWINGS

Reference now is made to the accompanying drawings in which.

DETAILED DESCRIPTION OF THE PREFERRED EMBODIMENT

Figure 1:
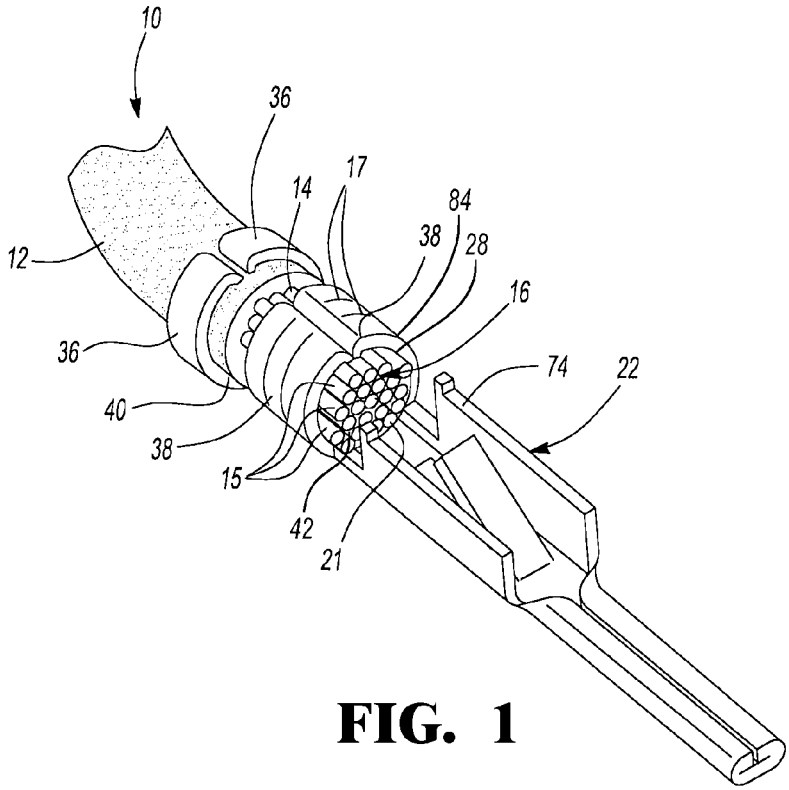
FIG. 1 illustrates an aluminum based cable and copper based terminal connection showing the exposed strand end of the aluminum based lead before a hot melt is molded over the connection in accordance with an aspect of the invention.

Referring to FIG. 1, an exemplary embodiment of the invention includes a cable 10 having an insulative outer cover 12 and an aluminum based core 14. Core 14 is made of a plurality of individual strands 15 bundled and twisted together. An end portion of insulative outer cover 12 is removed to expose a lead 16 of core 14. A terminal 22 made from a copper alloy has a rearward portion 84 including a pair of insulation crimp wings 36 and a pair of core crimp wings 38 with a notch or gap 40 therebetween. Wings 36 and 38 are crimped onto cable 10 such that terminal 22 is secured to insulative outer cover 12 and makes electrical contact with lead 16 of core 14. Voids 42 are formed between individual strands 15 of core 14 after terminal 22 is crimped onto cable 10. Core crimp wings 38 may optionally include serrations 17 to improve the bite of core crimp wings 38 into aluminum lead 16.

Figure 2:
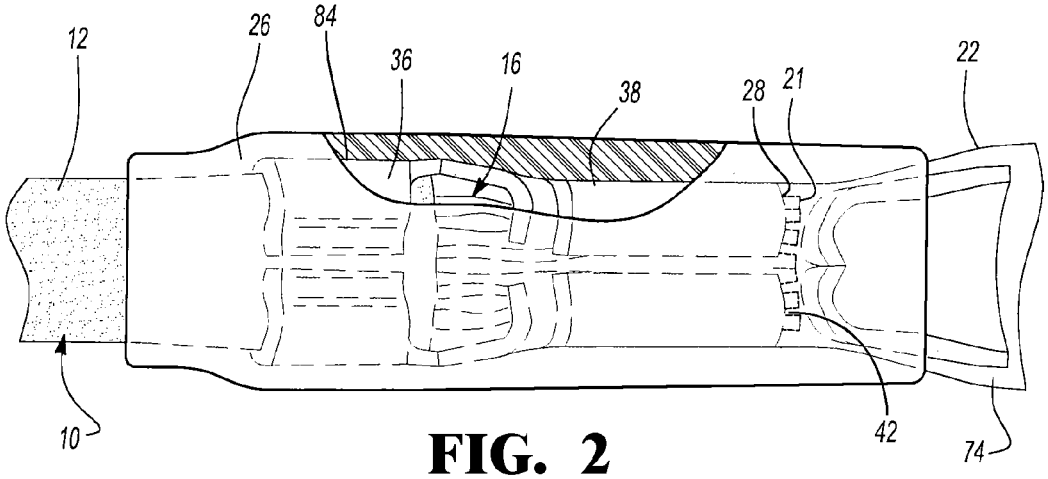
FIG. 2 is a plan and partially segmented view of a cable and terminal with a hot melt molded over the terminal and cable interface in accordance with one embodiment of the invention in accordance with an aspect of the invention.

Referring now to FIG. 2, a hot melt seal 26 is then molded about terminal 22 and cable 10 and its lead 16 where it interfaces with terminal 22 and crimped core crimp wings 38 and insulation crimp wings 36. Molded hot melt seal 26 is bonded to cable core 14 and terminal 22 and intimately surrounds and substantially fills any space around the entire interface 28 of cable core 14 with terminal 22 and seals interface 28 from ambient electrolytes. Hot melt 26 is molded to provide complete sealed coverage from crimped wings 36 to the axial distal end 21 of lead 16. Molded hot melt seal 26 is secured about insulation crimp wings 36 and core crimp wings 38 and intimately surrounds and substantially fills any space around exposed lead 16.

Gap 40 formed between pair of insulation crimp wings 36 and pair of core crimp wings 38 is filled with molded hot melt seal 26. Voids 42 formed between the individual strands 15 of core 14 are also filled with molded hot melt seal 26.

Figure 3:
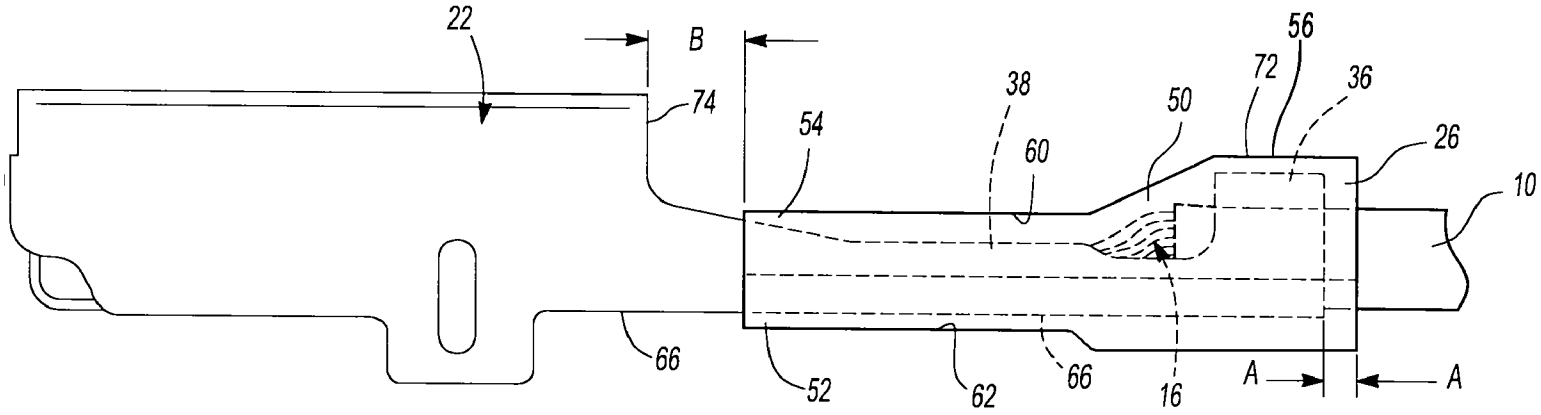
FIG. 3 is a side elevation view of the terminal and a mold schematically shown over the terminal and lead for molding the hot melt thereon in accordance with an aspect of the invention.
Figure 4:
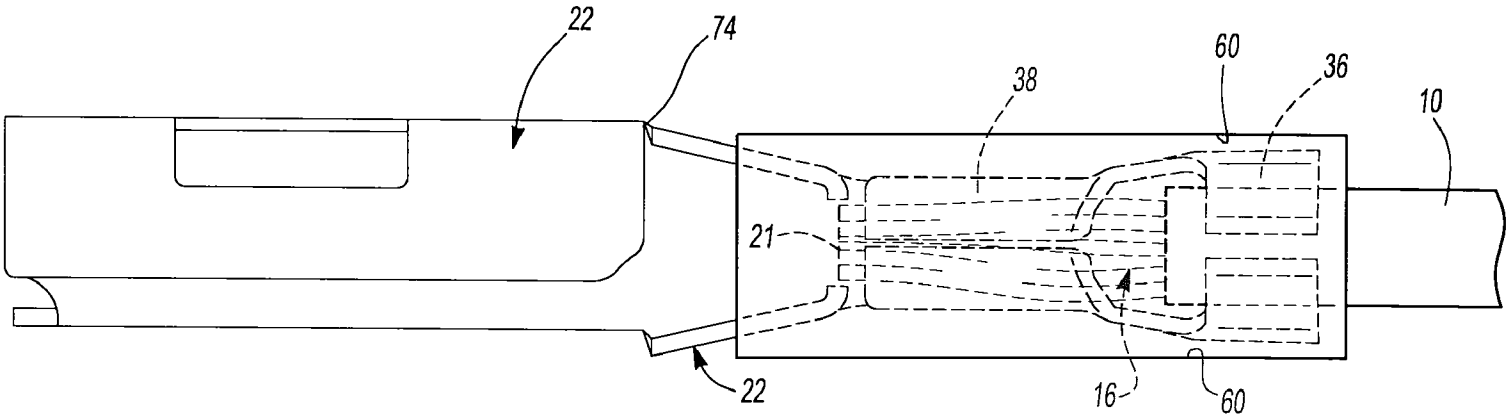
FIG. 4 is a plan view of the terminal and schematically shown mold shown in FIG. 3 in accordance with an aspect of the invention.

Referring now to FIGS. 3 and 4, hot melt seal 26 is shaped by a mold cavity 50 formed by mold halves 52 and 54 having walls 60 and 62. Terminal 22 and cable 10 are placed in position within cavity 50 after mold halves 52 and 54 are assembled together as shown in FIG. 3. Appropriate gate 56 is provided through the mold and into cavity 50 to assure hot melt can access and cover entire lead 16 and wings 36, 38. The hot melt also has a low enough viscosity to evenly distribute within and fill the entire cavity 50 between terminal 22, cable 10 and mold walls 60 and 62. Pressure molding may also be used to assure that the hot melt is evenly distributed within cavity 50. Once molded, the hot melt is cooled under mold pressure after which the assembly can be demolded to remove the assembled terminal from the mold.

In the embodiment shown in FIGS. 3 and 4, molded hot melt seal 26 extends 360 degrees about the terminal 22 and covers the bottom 66 of terminal 22. Sealant applied to the bottom of terminal 22 prevents air leakage as well as water intrusion between insulation wing 36 and cable 10 when compressed air is applied from end of cable 10, such as may be done during testing. The outer dimensions of hot melt mold seal 26 are sufficient to provide complete coverage to prevent ambient electrolytes from contacting terminal interface 28 between terminal 22 and lead 16. The outer dimensions of molded hot melt seal 26 are also small enough so as to not interfere with terminal 22 being installed into a connector housing. Hot melt seal 26 is also dimensioned so as not to interfere with any terminal position assurance device that may be part of any connector housing which the terminal is installed.

For example, with a cable 10 having an outer diameter ranging from 1.36-1.60 mm, and a terminal stock thickness of 0.25 mm, the height of the hot melt seal 26 at point 70 should be about 2.8 mm. The top surface 72 of the hot melt seal 26 should be 0.5 mm above the top surface of the terminal 22. The length of the hot melt seal 26 is about 16 mm and extends at least about 5 mm behind the insulation crimp wings 36 at line A-A. Preferably, the hot melt seal 26 provides at least about a 1.0 mm clearance with a forward mating terminal section 74 at line B. Other dimensions may apply for other sized cables and terminals in other applications.

Figure 5:
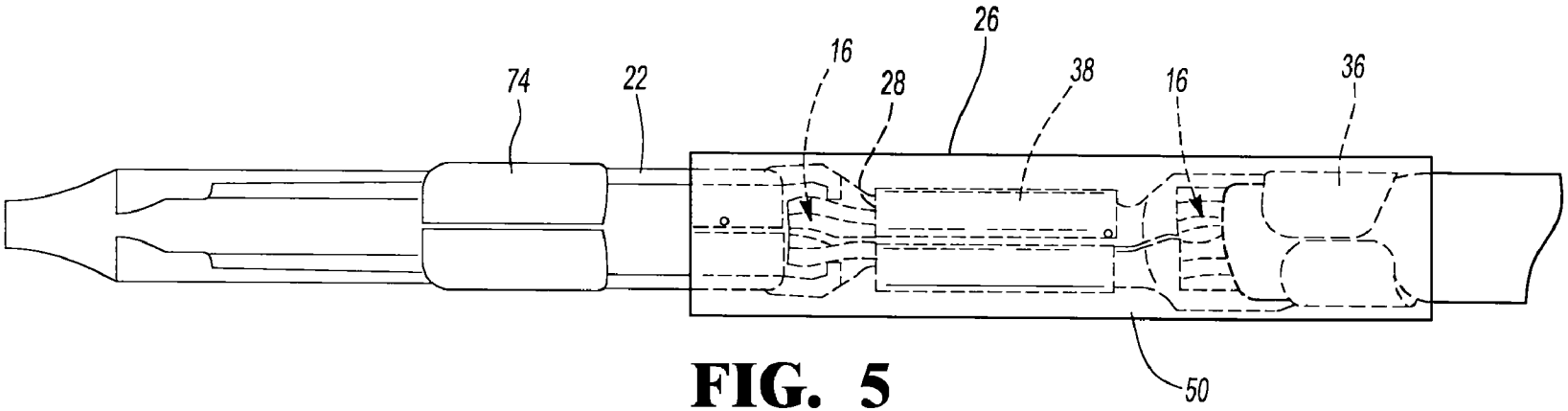
FIG. 5 is a side view of alternate embodiment of the terminal and mold in accordance with an aspect of the invention.
Figure 6:
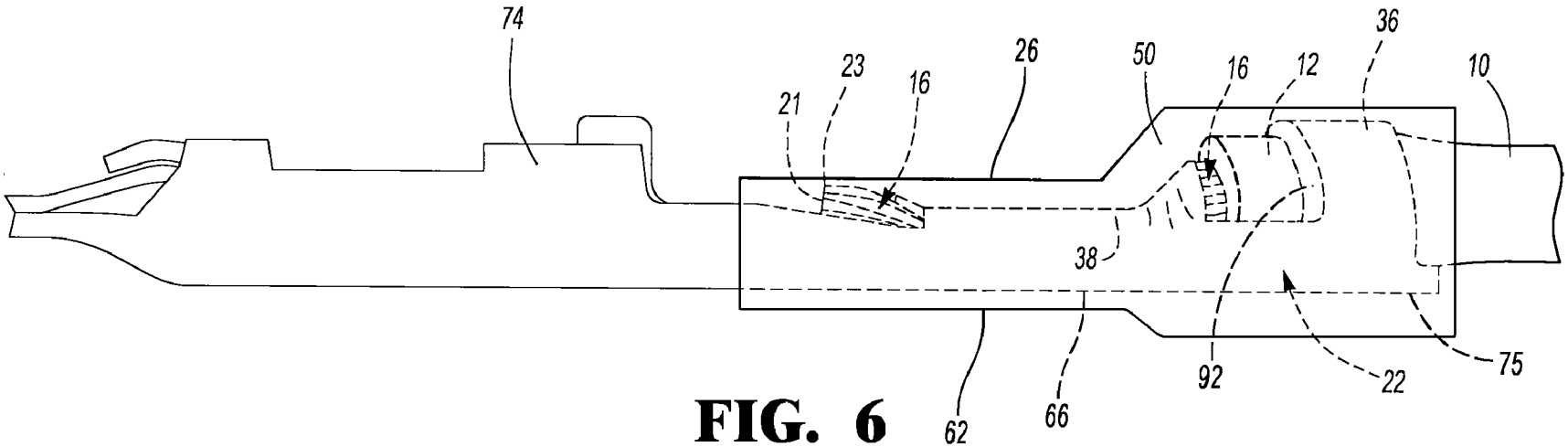
FIG. 6 is a plan view of the alternate embodiment shown in FIG. 5 in accordance with an aspect of the invention.

Referring now to FIGS. 5 and 6, bottom surface 66 of terminal 22 forms the bottom wall 62 of the cavity 50 such that the molded hot melt seal 26 extends from the terminal 22 and over the lead 16 of cable 10 as well as over the core crimp wings 38. Terminal bottom surface 66 is solid to support and with hot melt seal 26 close off interface 28 (shown on FIG. 1) of lead 16 with terminal 22 from ambient electrolytes. The viscosity of the hot melt being injected into the cavity 50 is low enough to pass by the cavity restriction at strand high point 23 at axial end 21. Molded seal 26 extends 360 degrees around terminal 22 and covers the bottom portion 75 of insulation wing 36 to prevent water intrusion between terminal 22 and cable 10.

Figure 7:
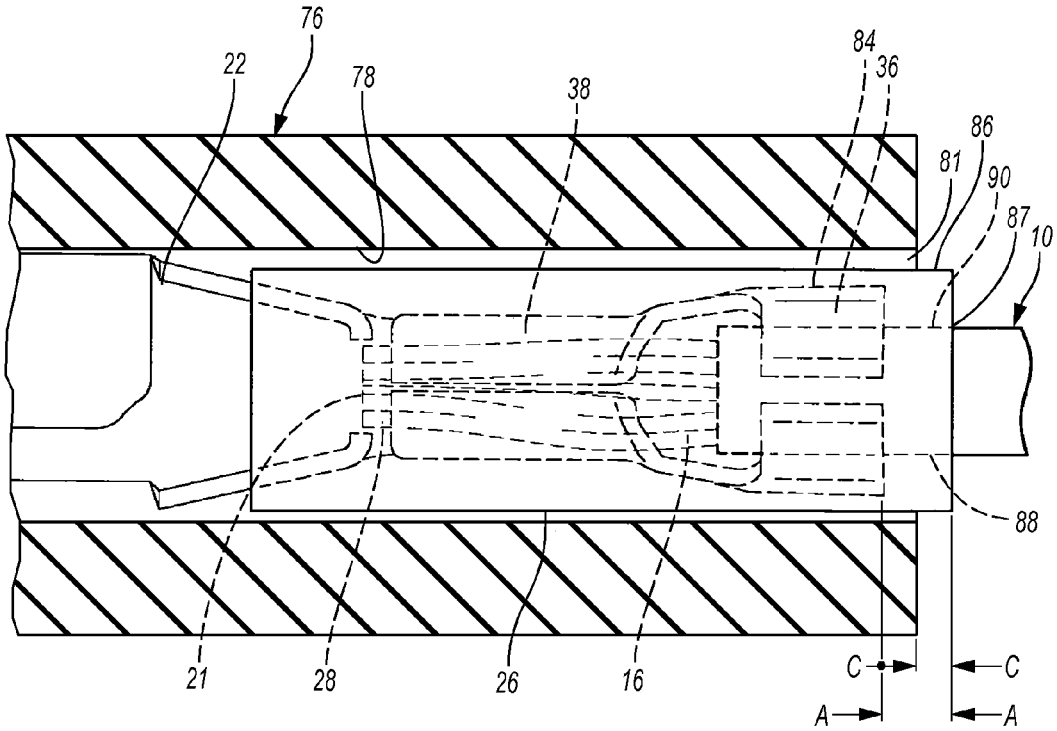
FIG. 7 is a plan view of a cable and terminal inserted into the cavity of an electrical connector with a hot melt molded over the terminal and cable interface in accordance with an aspect of the invention.

In an alternate embodiment shown in FIG. 7, an insulative electrical connector housing 76 defines a cavity 78 extending from an opening 81 in housing 76. Terminal 22 and lead 16 are disposed in cavity 78. Cable 10 extends from distal end 21 of lead 16, which is disposed in cavity 78, rearward through opening 81 in housing 76. Molded hot melt seal 26 extends 360 degrees about rearward portion 84 of the terminal 22. The outer dimensions of hot melt mold seal 26 are sufficient to provide complete coverage to prevent an ambient electrolyte from contacting the interface 28 between the terminal 22 and the lead 16. As shown in FIG. 7, molded hot melt seal 26 covers the lead 16 and the interface 28 between terminal 22 and lead 16. Hot melt seal 26 surrounds an axially extending segment 88 of cable 10 that extends from axial end 21 of cable 10 to a location 87 on cable 10 that is spaced a distance apart from housing 76. Location 87 on cable 10 is spaced a distance of at least about 1.0 mm, and preferably about 4.0 mm, indicated by C-C, outside of housing 76. In such embodiment, hot melt seal 26 is disposed coaxially with and around axially extending segment 88 of the cable 10 from distal end 21 of the lead 16 to the rearward end 86 of the hot melt seal 26. In a preferred embodiment C-C is about 4 mm. Hot melt seal 26 projects beyond housing 76 to provide strain relief and to suppress flexing of the portion 90 of cable 10 that is disposed within cavity 78. The outer dimensions of hot melt mold seal 26 are also small enough so as to provide sufficient clearance for terminal 22 to be installed into cavity 78 of connector housing 76. Hot melt seal 26 is also dimensioned so as to provide sufficient clearance for a terminal position assurance device (not shown) that may be part of a connector housing which the terminal is installed.

The hot melt may be a polyolefin, a polyurethane, a polyamide or a suitable polyester material. Each type of these materials provide for adequate adhesion with the terminal, core material and the insulative outer cover and provide for a complete and durable seal to reduce contact of electrolytes, such as, for example, a salt spray, with interface 28 of lead 16 and terminal 22 such that there is a significant reduction in corrosion. A polyamide is preferred when polyvinyl chloride (PVC) is used as the insulative outer cover 12. Also when lower mold temperatures are needed, polyamide is more suitable due to its lower melt temperature. A suitable polyamide may be Macromelt OM673 from Henkel. For example, a suitable polyolefin may be Macromelt Q5365 from Henkel. A suitable polyurethane may be XJG-626090 from Henkel.

By completely sealing interface 28 connection of lead 16 with terminal 22 from electrolyte such as salt water, significant improvement in galvanic corrosion resistance of aluminum based cable connection to copper based electrical terminals occurs. The crimped core crimp wings 38, being crimped onto the aluminum lead 16 before seal 26 is molded, provide a low resistance conductive interface and contact between the terminal 22 and cable 10. Molded hot melt seal 26 provides a greatly enhanced and complete seal of entire lead 16 and aluminum based core 14 and protects the electrical interface and contact between terminal 22 and lead 16. Hot melt seal 26 has significant durability in a harsh automotive environment and can withstand water spray, significant air flow pressures and thermal shock.

Figure 8:
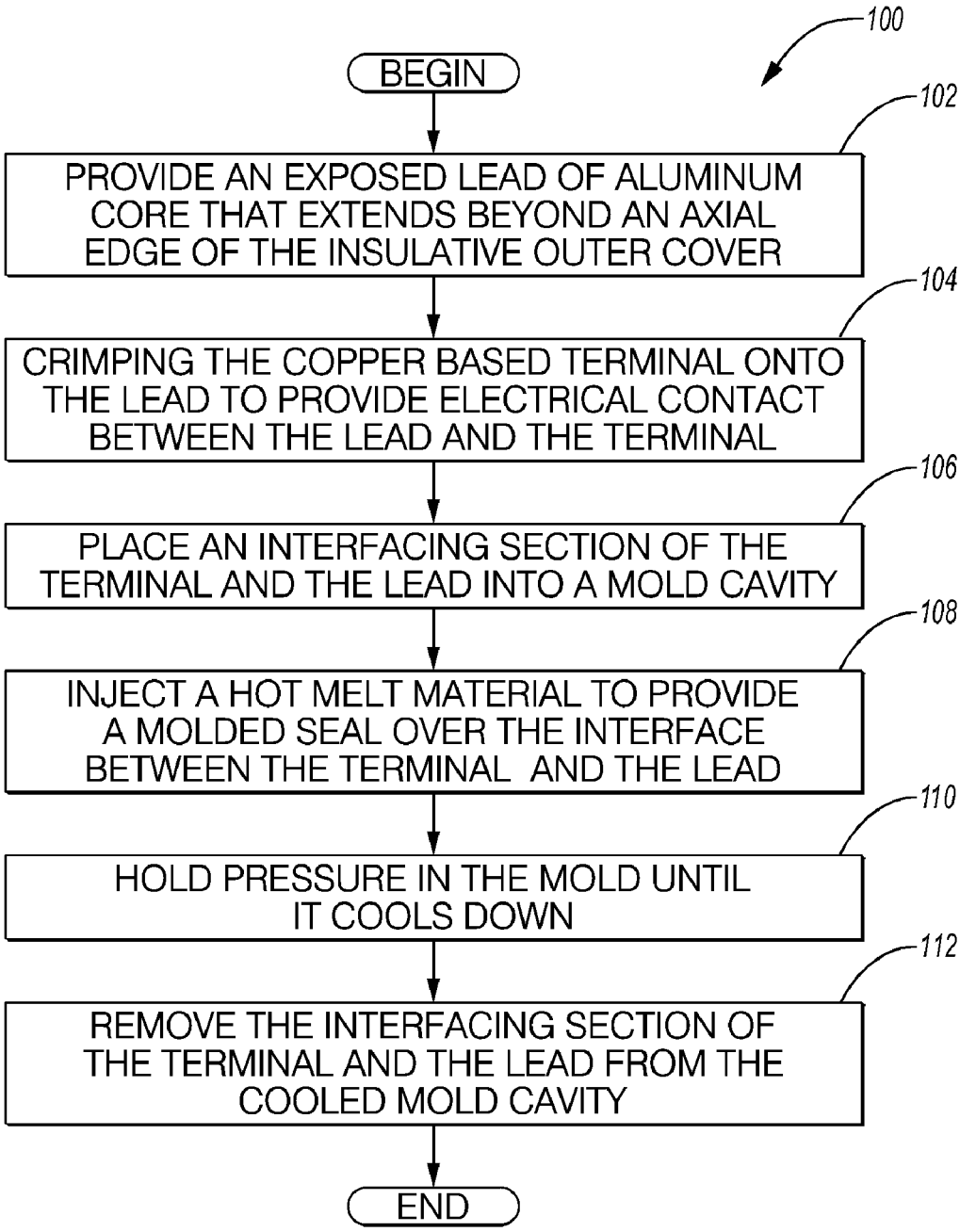
FIG. 8 illustrates a method of forming a seal about an aluminum core of a cable having an insulative outer cover and a copper based terminal in accordance with an aspect of the invention.

In accordance with yet another aspect of the invention, FIG. 8 illustrates a method 100 of forming a seal 26 about an aluminum based core 14 of a cable with an insulative outer cover 12 and a copper based terminal. Step 102 provides the exposed lead 16 of core 14 that extends beyond axial edge 92 of insulative outer cover 12. Step 104 crimps copper based terminal 22 onto lead 16 to provide electrical contact between lead 16 and terminal 22. Step 106 places interfacing section 28 of terminal 22 and lead 16 into mold cavity 50. Step 108 injects a hot melt material to provide a molded seal 26 over interface 28 between terminal 22 and lead 16. The method preferably further includes step 110 of holding pressure in mold cavity 50 while it cools down and then Step 112 of removing interfacing section 28 of terminal 22 and lead 16 from mold cavity 50 after the mold is cooled.

While the main application is for use with cable and terminal connections with different metals with varying galvanic potential, it is foreseen that the seal can also be used for terminals and cable made with similar or identical metals to seal the terminal and interface from a harsh environment.

Variations and modifications are possible without departing from the scope and spirit of the present invention as defined by the appended claims.

I claim:

1. An electrical connection structure comprising:

a conductive cable core;

a terminal connected to said cable core;

a molded hot melt seal bonded to said cable core and said terminal, said hot melt seal intimately surrounding and substantially filling any space around the entire interface of said cable core with said terminal and sealing said interface from ambient electrolytes, wherein said conductive cable core is made from aluminum or an aluminum alloy and said terminal comprises a copper alloy;

an insulative outer cover surrounding said cable core;

an exposed lead of said core disposed at one end of said core, said terminal comprising a pair of insulation crimp wings and a pair of core crimp wings, and said insulation crimp wings crimped onto said insulative outer cover and said core crimp wings crimped onto and making electrical contact with said exposed lead, said molded hot melt seal secured about said insulation crimp wings and said core crimp wings and intimately surrounding and substantially filling any space around said exposed lead; and a connector housing that defines a cavity having an opening, said exposed lead and said core crimp wings disposed in said cavity, said outer cover extending from an axial edge at said exposed lead through said opening, said molded hot melt seal entirely surrounding a length of said outer cover that extends from said axial edge to a location on said cover that is spaced a distance apart from said housing, whereby said hot melt seal suppresses flexing of said length of said outer cover.

2. The electrical connection structure as defined in claim 1, wherein said hot melt seal is made from a material selected from a group consisting of polyolefin, polyurethane, polyamide and polyester.

3. The electrical connection structure as defined in claim 1, wherein a gap formed between said pair of insulation crimp wings and said pair of core crimp wings is filled with said molded hot melt seal.

4. The electrical connection structure as defined in claim 1, wherein:

said core comprises a plurality of strands that when crimped has voids which are filled with said molded hot melt seal.

5. A corrosion resistant electrical connection structure comprising:

an electrically conductive cable having a core made from a first electrically conductive material and an insulative outer cover surrounding substantially an entire length of said core except for an uncovered portion that is free of said insulative outer cover;

a terminal electrically connected to said uncovered portion, said terminal being made of a second electrically conductive material;

a molded hot melt seal bonded to said cable and said terminal, said hot melt seal surrounding and substantially filling any space around both said uncovered portion of said core and the interface of said uncovered portion with said terminal, whereby said interface and said uncovered portion are effectively isolated and protected from exposure to ambient electrolytes; and a connector housing defining a cavity having an opening, said terminal and an axial edge of said cable disposed in said cavity, said cable extends from said axial edge through said opening, said hot melt seal surrounds a segment of said cable that extends from said axial end to a location on said cable that is spaced a distance apart from said housing.

6. The electrical connection structure as defined in claim 5, wherein said second electrically conductive material that is more electro-negative than said first electrically conductive material when exposed to an electrolytic environment.

7. The electrical connection structure as defined in claim 5, wherein said distance is at least 1.0 mm.

8. The electrical connection structure as defined in claim 5, wherein said hot melt seal is made from a material selected from a group consisting of polyolefin, polyurethane, polyamide and polyester.

9. The electrical connection structure as defined in claim 8, wherein said hot melt seal comprises polyamide and said insulative outer cover comprises polyvinyl chloride.

10. The electrical connection structure as defined in claim 5, wherein said first electrically conductive material selected from a group consisting of aluminum and aluminum alloy.

11. The electrical connection structure as defined in claim 10, wherein said second electrically conductive material selected from a group consisting of copper and copper alloy.

12. The electrical connection structure as defined in claim 5, wherein said terminal comprising a pair of insulation crimp wings and a pair of core crimp wings, said insulation crimp wings being crimped onto said outer cover and said core crimp wings being crimped onto and making electrical contact with said exposed lead, wherein said hot melt seal secured about said insulation crimp wings and said core crimp wings.

13. The electrical connection structure as defined in claim 12, wherein a gap formed between said pair of insulation crimp wings and said pair of core crimp wings is filled with said molded hot melt seal.

14. The electrical connection structure as defined in claim 13, wherein said core comprising a plurality of strands (15) that when crimped has voids which are filled with said molded hot melt seal.

* * * * *